United States Patent [19]

Dorfman

[11] Patent Number: 4,602,373

[45] Date of Patent: Jul. 22, 1986

[54] VARIABLE REACTIVE FORCE EXERCISE DEVICE

[75] Inventor: Walter Dorfman, Warminster, Pa.

[73] Assignee: Roy S. Robinson, Levittown, Pa. ; a part interest

[21] Appl. No.: 530,692

[22] Filed: Sep. 9, 1983

[51] Int. Cl.[4] ..... A63B 21/24; A63B 21/00

[52] U.S. Cl. ..... 272/129; 272/73

[58] Field of Search ..... 272/73, 114, 132, 129; 322/28, 1, 55, 40; 310/241, 40, 46; 128/689, 707

[56] References Cited

U.S. PATENT DOCUMENTS

| | | | |
|---|---|---|---|
| 275,842 | 4/1883 | Molera et al. . | |
| 396,932 | 1/1889 | Holt . | |
| 787,292 | 4/1905 | Hatch . | |
| 1,157,963 | 10/1915 | Shaw | 310/241 |
| 1,526,613 | 2/1925 | Stephenson . | |
| 1,734,907 | 11/1929 | Hull . | |
| 1,771,798 | 7/1930 | Lowe . | |
| 1,794,291 | 2/1931 | Hobart . | |
| 2,099,554 | 11/1937 | Bean | 310/241 |
| 2,774,925 | 12/1956 | Wagner . | |
| 3,135,907 | 6/1964 | Fay . | |
| 3,240,947 | 3/1966 | Mas | 272/73 |
| 3,480,813 | 11/1969 | Sillano . | |
| 3,505,992 | 4/1970 | Jaeger | 272/73 |
| 3,511,097 | 5/1970 | Corwin | 272/73 |
| 3,601,644 | 8/1971 | Perlino . | |
| 3,767,195 | 10/1973 | Dimick . | |
| 3,869,121 | 3/1975 | Flavell . | |
| 4,060,239 | 11/1977 | Pfleiderer et al. . | |
| 4,114,061 | 9/1978 | Hayes | 310/241 |
| 4,141,630 | 2/1979 | Emmons . | |
| 4,184,678 | 1/1980 | Flavell et al. . | |
| 4,261,562 | 4/1981 | Flavell . | |
| 4,278,095 | 7/1981 | Lapeyre . | |
| 4,298,893 | 11/1981 | Holmes | 272/73 |

FOREIGN PATENT DOCUMENTS

| | | |
|---|---|---|
| 2822343 | 11/1979 | Fed. Rep. of Germany . |

*Primary Examiner*—Richard J. Apley
*Assistant Examiner*—S. R. Crow
*Attorney, Agent, or Firm*—Finnegan, Henderson, Farabow, Garrett & Dunner

[57] ABSTRACT

A variable, reactive force, exercise device which employs a generator with variably positionable commutation brushes and a short circuit load therebetween, to supply a variable opposition force for an operator of the exercise device to overcome.

20 Claims, 15 Drawing Figures

Fig. 1
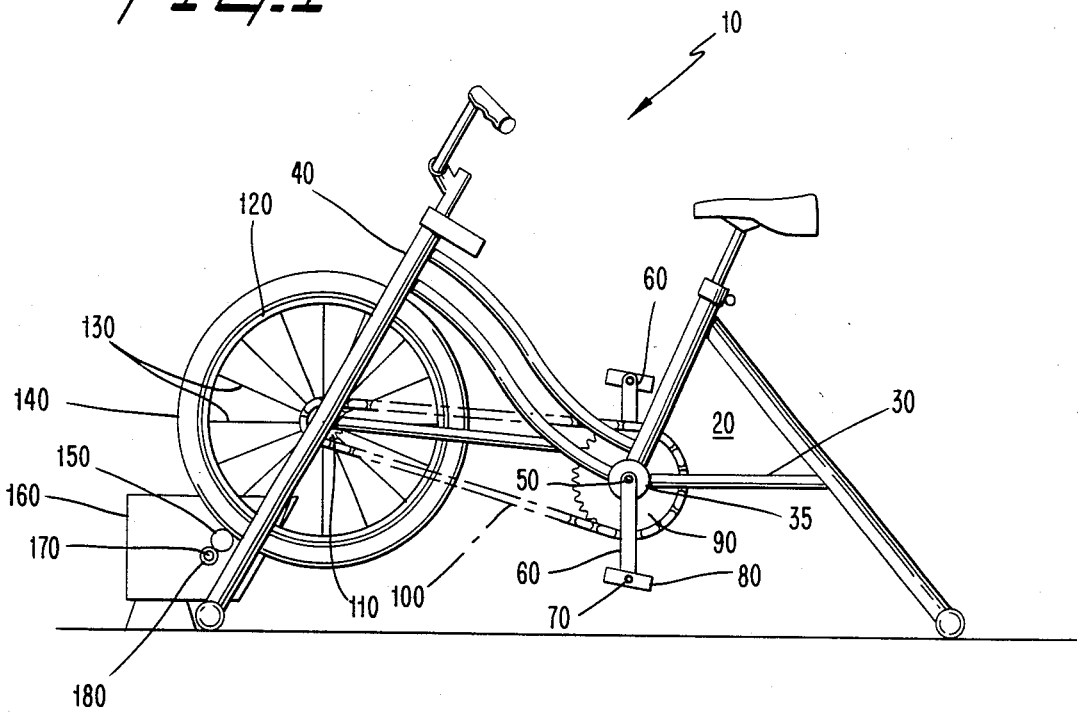
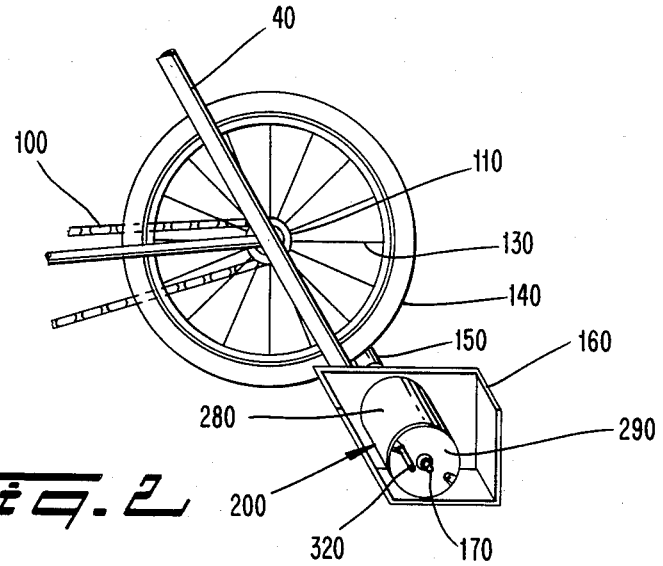
Fig. 2

Fig. 6
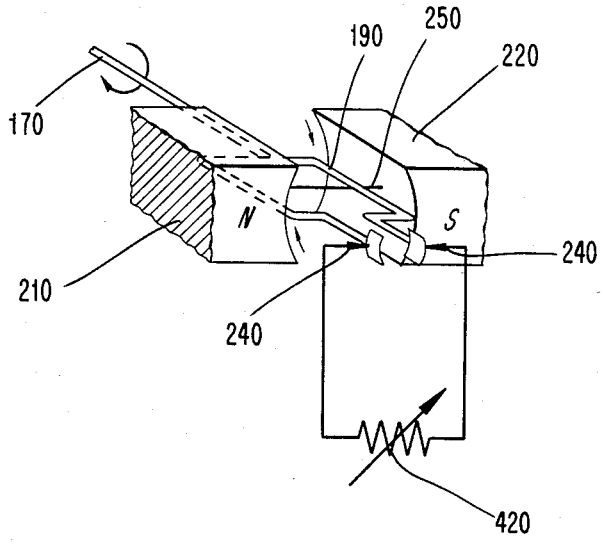
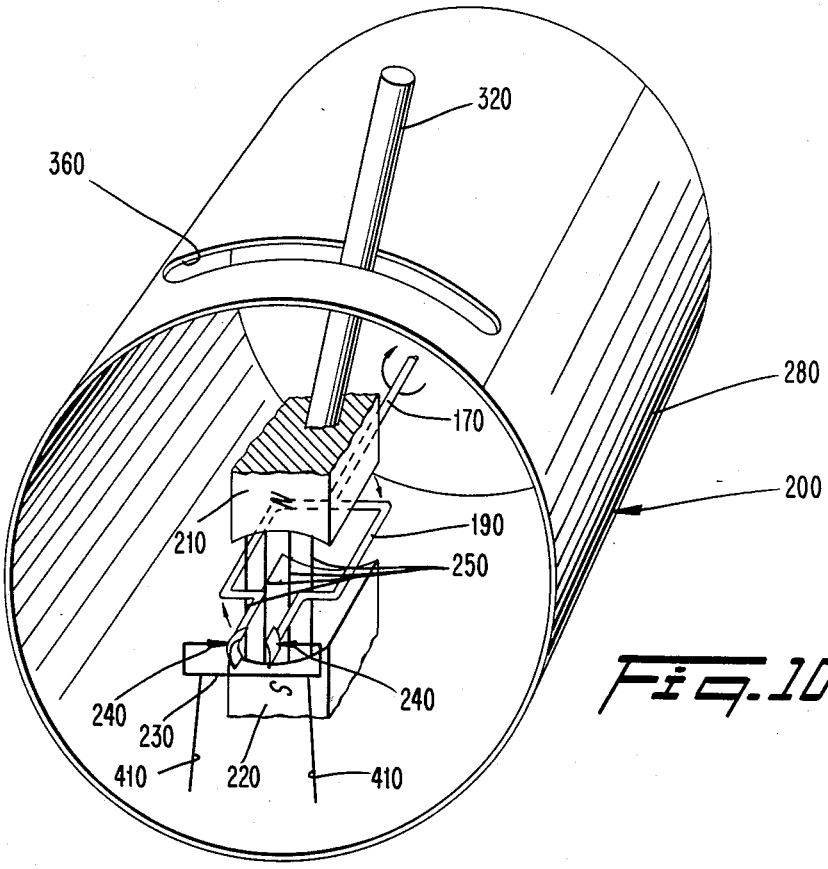
Fig. 10

VARIABLE REACTIVE FORCE EXERCISE DEVICE

BACKGROUND OF THE INVENTION

1. Field of the Invention

This invention relates to exercise devices in which operator exerted force rotates an armature to cause an electromagnetically induced reactive force that opposes the rotational force being exerted by the operator.

2. The Prior Art

It is known in the art of exercise devices to translate a force exerted by an operator of the device into a positive torque that rotates an axial member. Various electromagnetically operated means have been used to oppose the force exerted by the operator by opposing rotation of that axial member.

In such prior art devices, the electromagnetically formed opposition is based upon the well-known fact that a voltage will be induced in an electrical conductor moved at right angles through a primary magnetic field, with the magnitude of that voltage being proportioned to the speed of the moving conductor. If the moving conductor is connected to a load to form a closed loop, a speed-proportional current will flow in the closed loop. This current generates a secondary magnetic field around the moving electrical conductor. The direction and polarity of the secondary magnetic field opposes the direction and polarity of the primary magnetic field. The force produced by the secondary magnetic field therefore opposes the force which is responsible for originally moving the electrical conductor. This opposing force becomes a load against the original moving force.

The magnitude of the opposing force so produced has been controlled in prior art exercise devices through variation of the load coupled to the moving conductor. Resistors, zener diodes, switches, transistors, etc, have been used as a variable load to control the magnitude of current induced in the moving conductor loop and thereby control the magnitude of opposing force. Two such prior art devices are disclosed in Forsman (U.S. Pat. No. 4,084,810) and Lulay et al (U.S. Pat. No. 3,705,721).

In Forsman, a person operating the exercise device disclosed therein applies a force to rotate a drive shaft. An asynchronous motor opposes rotation of the drive shaft by the operator with a constant resistance called the braking moment. This motor has a stator with windings connected to an external AC supply and a rotor of ferromagnetic material having a circular circumference. An epicyclic gearing arrangement operatively connects the drive shaft to the rotor. Rotation of the drive shaft by the operator powers the rotor in a direction that induces current in the stator windings opposing the natural rotation of the motor due to the external AC supply. In order to keep this opposition constant and independent of the rotational speed of the rotor, Forsman discloses a control circuit which senses what force is being supplied by the exercise machine operator, and accordingly adjusts the current flowing through the stator windings.

In Lulay et al, an armature of a generator is rotated by a torque physically generated by the operator of an exercise device. The output of the generator is connected to a variable load, for example, a variable resistor device. An electronic regulator circuit is provided to respond to generator output by increasing or decreasing, as required, the magnitude of the resistance connected to the generator rotor in order to maintain a constant generator output and, therefore, a constant work load for the exercise machine operator. However, the electronic devices required in conjunction with the regulator to maintain the constant generator output are complex and require for their operation an electrical power source independent of the generator output, until the operator begins to generate sufficient power from the generator of the exercise device to power these electronic devices.

OBJECTS AND SUMMARY OF THE INVENTION

It therefore is the principal object of the present invention to provide a variable, reactive force, exercise device that does not require varying an external electrical load across an electric generator to change the magnitude of the reactive force generated by the device.

It also is an object of the present invention to provide a variable, reactive force, exercise device that exhibits smooth control between minimum and maximum torque-loading capabilities.

An additional object of the present invention is to provide a variable, reactive force, exercise device that does not require an external source of electric power for operation.

A further object of the present invention is to provide an improved variable, reactive force, exercise device in which the reactive force exhibits a predictable performance.

Another object of the present invention is to provide a variable, reactive force, exercise device utilizing components and manufacturing techniques of an existing and proven nature so that the device may be mass-produced at relatively low cost.

These and other objects of the present invention are accomplished by a variable, reactive force, exercise device comprising: means for generating a magnetic field, an armature having at least one open conductor loop and being rotatable along a rotational path cutting across magnetic flux lines of the field, operator means for enabling an operator of the exercise device through the exertion of physical force to rotate the armature, an electrical load, at least two electrical contact brushes, the load being electrically coupled between the brushes and the brushes being positioned to couple the load electrically to the loop at least at one point in the loop's rotational path where the loop is at a predetermined orientation relative to the magnetic flux lines of the magnetic field, and control means for selectively varying the relative orientation of the loop to the magnetic flux lines at least at one point in the loop's rotational path where the loop is coupled to the load.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a side view of an embodiment of the present invention;

FIG. 2 is a close up partial view of the embodiment of FIG. 1;

FIG. 6 is a partial schematic perspective view of an alternative embodiment of the load of the present invention;

FIG. 10 is a partial perspective schematic view of a third embodiment of the invention shown in FIGS. 1 and 2;

Figure 3:
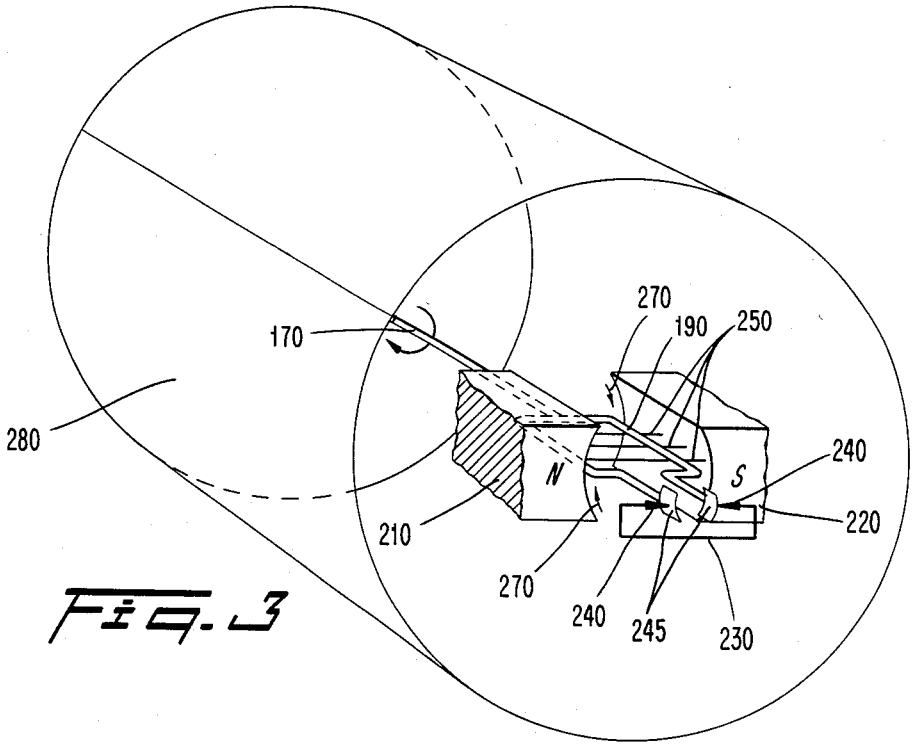
FIG. 3 is a partial perspective schematic view of one possible predetermined orientation of the magnetic field and the loop of the embodiment of FIGS. 1 and 2.

Additional objects and advantages of the invention will be set forth in part in the description which follows, and in part will be obvious from the description or may be learned by practice of the invention.

DESCRIPTION OF THE PREFERRED EMBODIMENTS

Reference now will be made in detail to the present preferred embodiments of the subject invention, as illustrated in the accompanying drawings.

Referring now to FIG. 1, an embodiment of the variable, reactive force, exercise device of the invention is indicated generally by the numeral 10. The embodiment illustrated in FIG. 1, by way of example and not limitation, is a stationary exercise cycle. However, the invention is contemplated for use in any exercise device having means for translating physical force into rotation of an armature. A representative list of examples of such devices includes stationary rowing machines, treadmills and weight lifting machines. Moreover, utilization of the present invention is not limited to human-operated devices, but encompasses animal-operated devices.

In accordance with the present invention, the exercise device includes operator means for enabling an operator of the device through the exertion of physical force to rotate an armature. As embodied herein, the operator means is included in an exercise cycle and comprises a frame, indicated generally in FIG. 1 by the numeral 20. Frame 20 includes a front support 40 and a rear support 30. A central housing 35 is fixed to one end of rear support 30. An axle 50 is supported in housing 35 by bearings (not shown) and is free to rotate relative to the bearings and the housing. An individual crank 60 is fixed at each end of axle 50. A pedal shaft 70 is fixed at the outermost end of each crank 60 with a pedal 80 rotatably mounted on each pedal shaft.

Axle 50 also is fixed to a sprocket wheel 90, which has teeth for engaging a drive chain 100. A toothed drive sprocket 110 is fixed to an axle (not shown) rotatably mounted via bearings (not shown) in front support 40 for engaging drive chain 100. Drive sprocket 110 is attached to a wheel rim 120 via wheel spokes 130. Mounted on wheel rim 120 is a friction surface 140, which may be solid or inflatable, rubber or plastic. A rubber tire would be one example of friction surface 140.

When the operator causes axle 50 to rotate by turning cranks 60, friction surface 140 is rotated through the intraction of sprocket wheel 90, drive chain 100 and drive sprocket 110. A friction disc 150 is rotatably mounted outboard of a generator support platform 160 to engage friction surface 140 and to rotate in a direction opposite to the rotational direction of the friction surface. One end of a generator armature 170 also extends outboard of generator support platform 160. A friction ring 180 is fixed to the outboard end of generator armature 170 to engage friction disc 150 so that rotation of friction disc 150 causes a direct rotation of friction ring 180 and generator armature 170.

In accordance with the present invention, means are provided for generating a magnetic field. As embodied herein, the invention includes a generator 200 which includes fixed opposite magnetic poles 210, 220, as shown in a schematic perspective view in FIGS. 3, 4, 6 and 10. Magnetic flux lines 250, which are representative of a magnetic field, extend between poles 210 and 220. Multiple pairs of poles like poles 210, 220 may be employed in other embodiments of the present invention. Wire wound electromagnets also may be employed as the means for generating a magnetic field. Moreover, the strength of the electric field generated by the electromagnets may be varied as known in the art of electromagnets.

Further in accordance with the present invention, an armature is provided that has at least one open conductor loop and that is rotatable along a rotational path through a magnetic field such that the loop cuts across magnetic flux lines of the field. By way of illustration, as embodied herein, one end of generator armature 170 is fixed to at least one open conductor loop 190, as shown schematically in FIGS. 3, 4, 6, 10 and 13. Open conductor loop 190 of FIGS. 3, 4, 6 and 10 comprises part of the electrical generator 200, shown for example in FIGS. 2, 7 and 8. Open conductor loop 190 is free to rotate along its rotational path within magnetic poles 210 and 220 such that loop 190 cuts across magnetic flux lines 250 between the poles.

Figure 4:
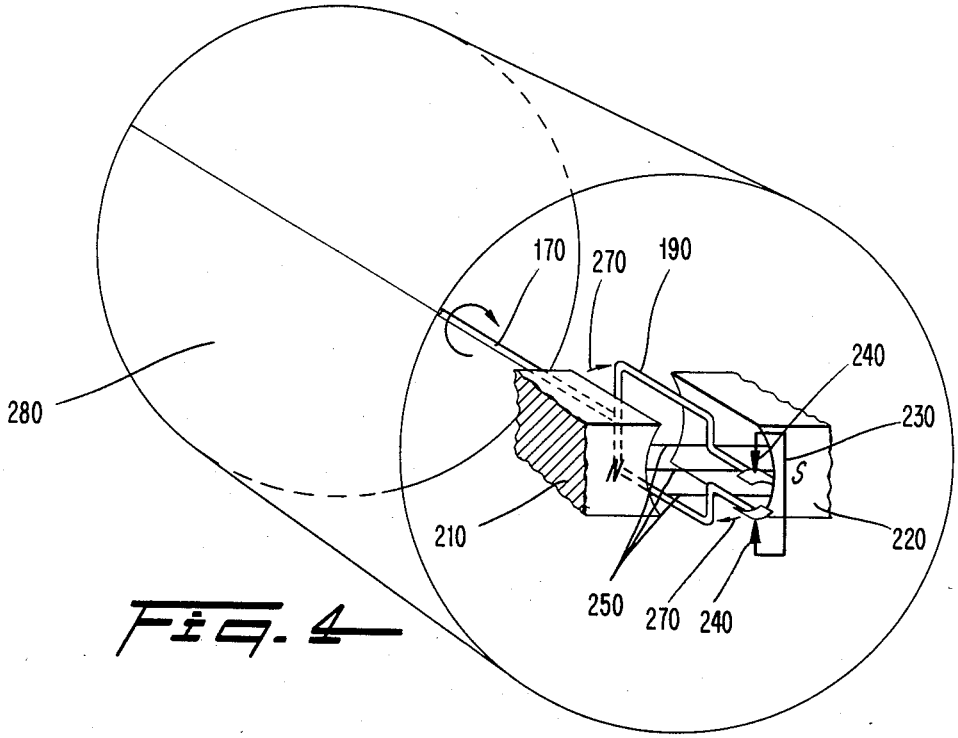
FIG. 4 is a partial perspective schematic view of another possible predetermined orientation of the magnetic field and the loop of the embodiment of FIGS. 1 and 2.
Figure 8:
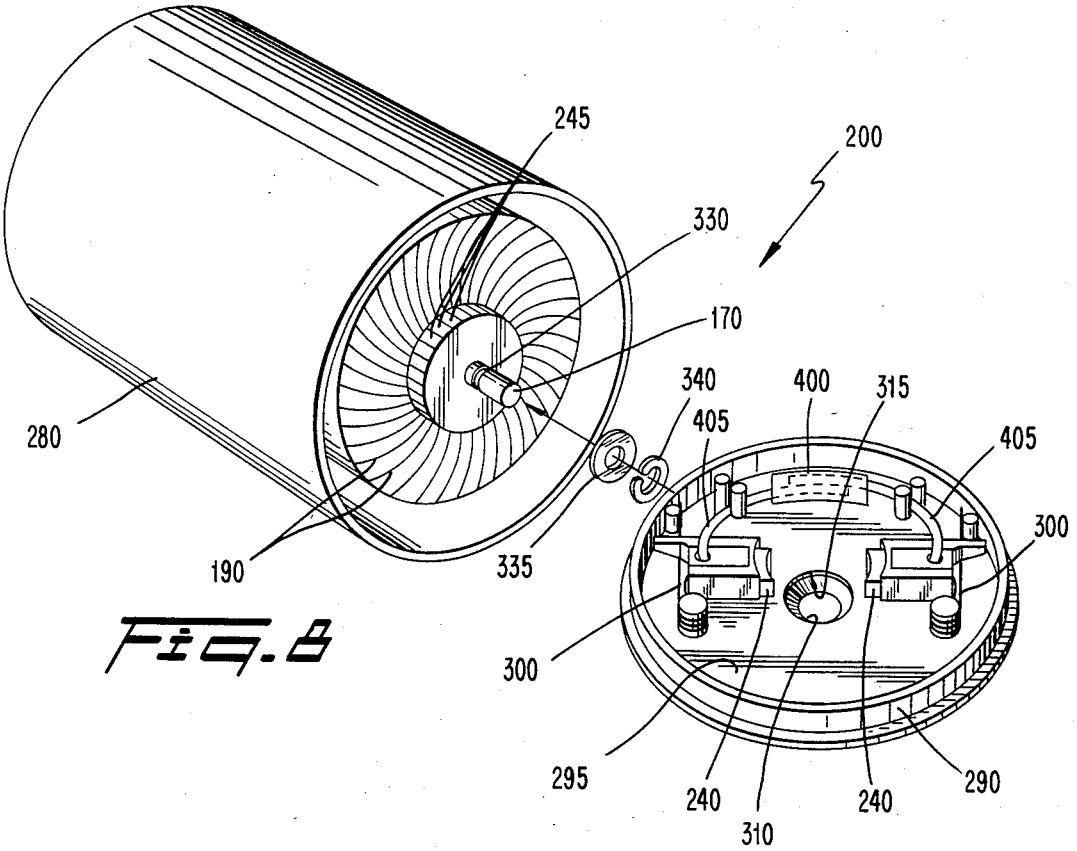
FIG. 8 is a perspective view of the generator and brush portion of the preferred embodiment of the present invention shown in FIG. 7.
Figure 9:
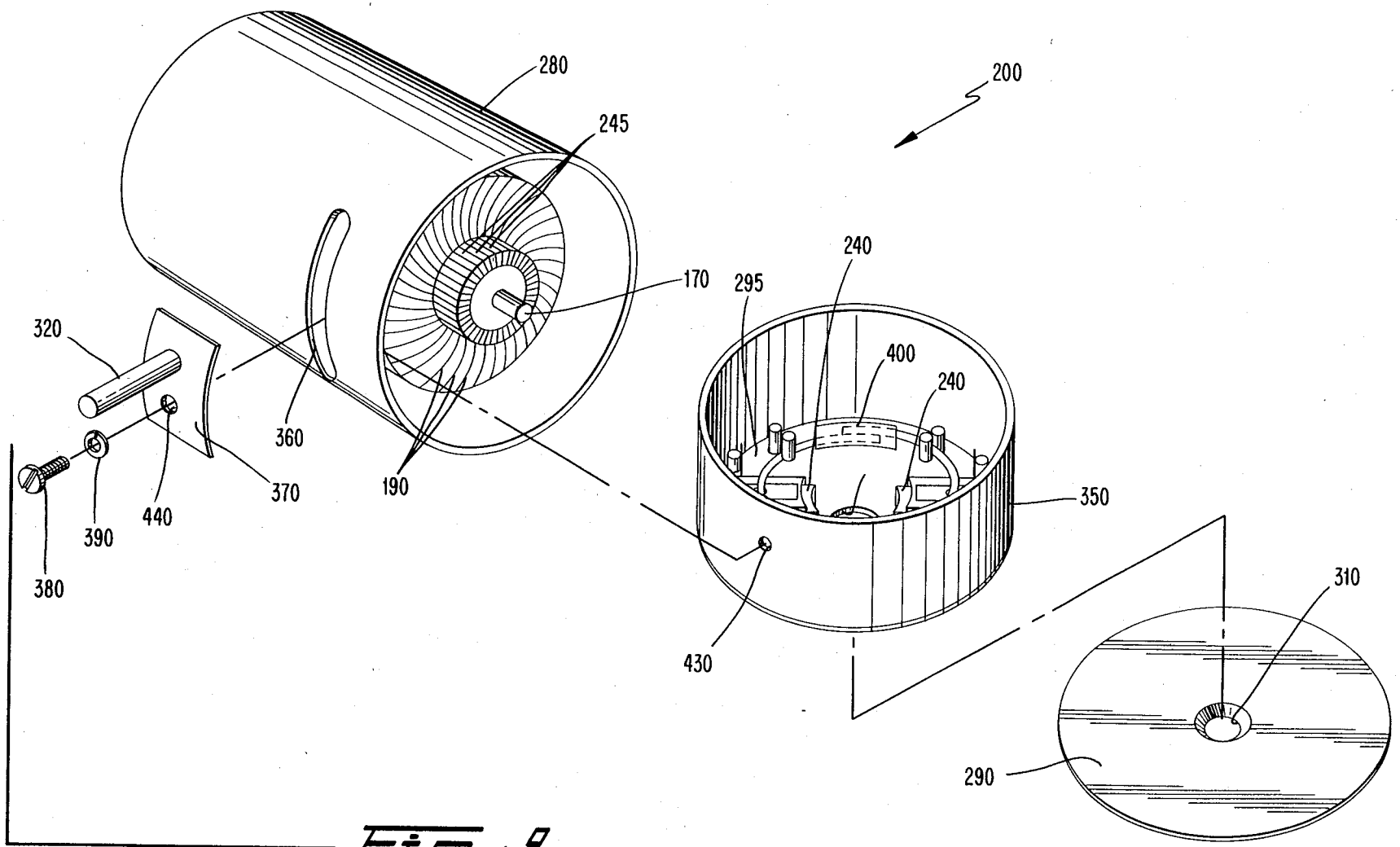
FIG. 9 is a perspective view of the generator and brush portion of a second embodiment of the present invention.

In still further accordance with the present invention, there are provided at least two electrical contact brushes and an electrical load, with the load electrically coupled between the brushes, which themselves are positioned to couple the load electrically to the open conductor loop at the points in the rotational path of the loop when the loop is at a predetermined orientation relative to the magnetic flux lines of the magnetic field. For example, as embodied herein, an electrical load 230 and electrical contact brushes 240 are illustrated in FIGS. 3, 4 and 10. Load 230 is coupled between brushes 240. Load 230 preferably is a short circuit conductor 400, as illustrated in FIGS. 8 and 9. Each brush 240, in addition to being electrically coupled to load 230, is positioned to electrically contact one of a pair of commutator segments 245, shown in FIGS. 8 and 9, fixed at each end of open conductor loop 190.

However, although not required for operation of the invention, load 230 may include a variable resistance 420, such as illustrated in FIG. 6, to augment the operation of the invention. Load 230 also may comprise a constant electrical load resistance, although, as mentioned before, load 230 is preferably a simple short circuit 400 across brushes 240.

Only one open conductor loop 190 is shown in FIGS. 3, 4, 6 and 10 to facilitate explanation and understanding of the present embodiment of the invention. Thus, FIGS. 3, 4, 6 and 10 show a single armature winding, a two segment commutator and a pair of diametrically opposed brushes. However, multiple armature windings and multiple segment commutators may be used in generator 200. For example, in FIGS. 8 and 9, electrical generator 200 is shown to be provided with a plurality of open conductor loops 190. Each loop 190 represents one armature winding of generator 200. Moreover, in some instances, more than two brushes may prove to be advantageous, and their relative position need not be diametrically opposed if a different relative position is required to accommodate the structure of the armature windings or commutator segments. These multiple armature windings and multiple segment commutators will work and perform in the same manner as shortly will be explained in the following simplified description of the single winding armature.

Figure 7:
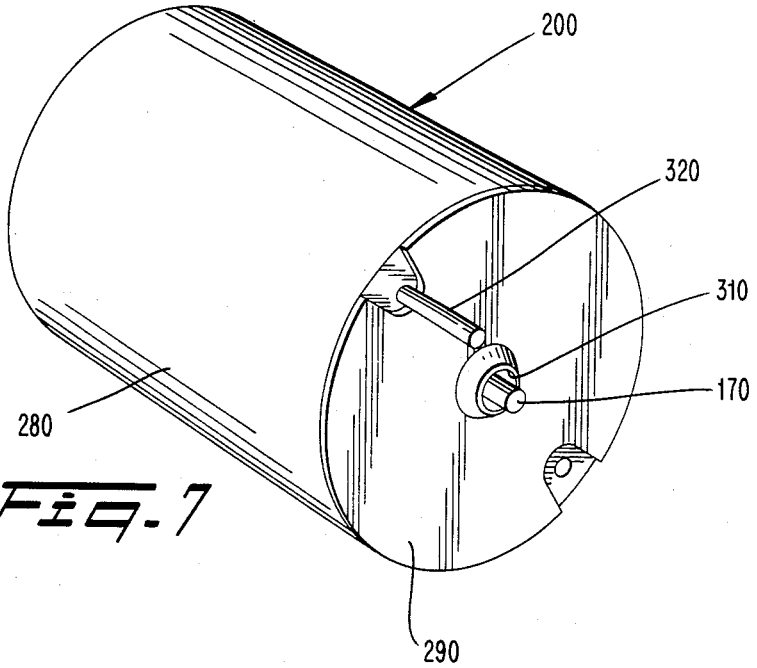
FIG. 7 is a perspective front view of the generator of the preferred embodiment of the invention shown in FIG. 2.

In yet further accordance with the present invention, enclosure means may be provided with respect to which the positions of the brushes are fixed and for partially enclosing an armature. As shown in FIGS. 7 and 8, a generator housing 280 for generator 200 is provided that is closed at one end by a generator end plate 290, which rotatably engages the edge of cylindrical housing 280. End plate 290 is circular and may be made from a metallic material.

In accordance with the present invention, control means are provided for selectively varying the relative orientation of each open conductor loop to the magnetic flux lines at the point along the loop's rotational path where the loop is coupled to the load. For example, the position of brushes 240 along the rotational path followed by loop 190 may be adjusted to different predetermined positions so that the orientation of loop 190 relative to magnetic flux lines 250 where load 230 is connected to loop 190 can be varied accordingly.

The preferred embodiment of the control means for selectively positioning the electrical contact brushes to vary, accordingly, the predetermined position of the open conductor loop relative to the magnetic flux lines where the loop is closed by being coupled with the brushes, may include a brush support disc fixed 295 to one side of a generator end plate 290, to the other side of which is fixed a handle 320. As shown by way of illustration in FIG. 8, brushes 240 are slidably secured to brush support disc 295. Each brush 240 is biased toward the center point of support disc 295 by a metal biasing spring 300. Brush support disc 295 is a circular disc, which may be molded from electrically insulating material, such as a rigid plastic material. Support disc 295 fits into a shallow depression in the inside facing surface of generator end plate 290. Brush support disc 295 is fixed to the interior facing side of end plate 290 so that the support disc and end plate will rotate together. Brushes 240 are slidably secured to support disc 295 so that the brushes may move towards and away from each other along a straight line path.

When end plate 290 engages the edge of generator housing 280, armature 170 protrudes through a circular opening 310 in the center of end plate 290 and through a circular opening 315 in the center of support disc 295, and brushes 240 are biased by springs 300 to contact commutator segments 245 on armature 170. Handle 320 is fixed to the edge of the side of end plate 290 opposite to the side on which support disc 295 is fixed.

Near the end of armature 170 protruding through openings 310, 315, is a notch 330 for receiving a spring washer 335 and a retaining clip 340 to rotatably secure end plate 290 onto the edge of generator housing 280. This securing arrangement permits armature 170 to rotate relative to end plate 290 and housing 280 and permits end plate 290 and support disc 295 to be rotated relative to housing 280. This securing arrangement also simultaneously centers and supports the armature. The edge of generator housing 280 engages end plate 290 by friction between the interfacing surfaces of the end plate and housing. This frictional engagement prevents rotation of end plate 290, and accordingly support disc 295, during normal operation of generator 200. The threshold torque required to overcome this frictional engagement may be supplied manually by grasping handle 320 and urging it in a circular direction relative to housing 280. Movement of handle 320 correspondingly changes the orientation of brushes 240 so that coupling of loop 190 via electrical leads 405 with the load (shown in FIG. 8 as short 400) occurs where loop 190 is at a changed orientation relative to the magnetic flux lines 250. The rotational displacement of handle 320 is, thus, directly related to the angle of attack between the conductor loops 190 and the magnetic field direction at a point along the rotational path of loop 190 where electrical coupling takes place between the brushes 240 and each loop 190. Accordingly, the position of handle 320 corresponds to a particular magnitude of the opposition torque that must be overcome by the operator of the exercise machine.

In a second embodiment of the control means of the present invention shown in FIG. 9, support disc 295 is fixed to one end of a cylindrical sleeve 350, which may be made from heavy duty paperboard or rigid plastic. The diameter of sleeve 350 is slightly less than the diameter of housing 280 so that sleeve 350 fits rotatably inside housing 280. Cylindrical sleeve 350 is provided with an opening 430 for engaging a position adjustment screw 380 through slot 360 when sleeve 350 is positioned so that brushes 240 contact commutator segments 245. On the inside surface of sleeve 350 a metal plate (not shown) is provided and fixed in place behind opening 430. A tapped hole (not shown) coincident with opening 430 is also provided in the metal plate. If made in separate pieces, support disc 295 and sleeve 350 may be fixed together using epoxy or other strong adhesive.

In this alternative embodiment, housing 280 of generator 200 includes an adjustment slot 360 through one side of the housing. Adjustment slot 360 extends in a circumferential direction around housing 280 for approximately one quarter of the circumference of the housing, which in this embodiment coincides with the angular displacement of handle 320 required to produce the full range (maximum to minimum) of opposition torques. Handle 320 is fixed to a mounting plate 370, which has a circular curvature corresponding to the curvature of housing 280 and has a screw aperture 440 to allow passage of position adjustment screw 380 through the mounting plate. Although not specifically illustrated, the underside of plate 370 may be faced with a felt-like material to provide a relatively non-wearing frictional surface between plate 370 and housing 280 that produces a smooth feeling movement of handle 320.

Assembly of this second embodiment proceeds by inserting cylindrical sleeve 350 attached to support disc 295 inside housing 280 so that brushes 240 contact commutator segments 245 and armature 170 extends through opening 315 in disc 295. Then mounting plate 370 is placed along the exterior surface of housing 280 so that screw aperture 440 lines up with adjustment slot 360. Adjustment screw 380 is then inserted successively through aperture 440 in plate 370, slot 360 in housing 280, and opening 430 in sleeve 350. Finally, screw 380 is threaded into the tapped hole in the metal plate (not shown), which is fixed to the inside surface of sleeve 350. A lock washer 390 may be inserted between adjustment screw 380 and mounting plate 370 to effect a more positive locking of the orientation of cylindrical sleeve 350, and thus brushes 340, when adjustment screw 380 is tightened against the outside surface of plate 370. End plate 290 is then placed over the end of housing 280 so that armature 170 protrudes through opening 310 in end plate 290 to center and support the armature. End plate 290 may be secured to housing 280 by crimping the edge of housing 280, welding or other means of attachment.

A third embodiment of the control means of the present invention is provided for selectively positioning the magnetic means relative to a fixed frame of reference to vary, accordingly, the predetermined position of the conductor loop relative to the magnetic flux lines when the loop is closed by being coupled with the load. For example, as shown schematically in FIG. 10, it also is possible to vary the angle of attack by changing the fixed position of magnetic poles 210 and 220 by manual adjustment of handle 320. In this alternative embodiment, the orientation of electrical contact brushes 240 is kept fixed relative to housing 280 by the use of insulated attachments, schematically represented in FIG. 10 by the two lines designated 410.

If, as shown in FIGS. 3 and 4, magnetic poles 210, 220 are fixed so that the orientation of the magnetic field direction is constant, then the position of brushes 240 can be used to determine the relative angle between loop 190 and magnetic flux lines 250 at the point of coupling between load 230 and loop 190. Similarly, if electrical contact brushes 240 are fixed so that they always couple loop 190 to load 230 where the plane of loop 190 is at the same attitude relative to a fixed plane of reference, then the position of magnetic poles 210, 220 can be varied to determine the relative angle between loop 190 and magnetic flux lines 250 at the point of coupling between load 230 and loop 190.

As further embodied herein, the control means may be used in conjunction with a means for generating a variable magnetic field and means for varying the electrical resistance of the electrical load coupled to the contact brushes. For example, as illustrated schematically in FIG. 13, handle 320 is provided for adjusting the orientation of brushes 240. Opposite electromagnetic poles 210 and 220 are connected to a variable DC electric power source 450, which can vary the magnetic field strength in the region of the rotational path of loop 190. Variable resistance 420 is coupled between electrical contact brushes 240. Thus, in this further embodiment the magnitude of the opposition force may be changed by adjusting the angle of attack with handle 320, adjusting the variable resistor 420, adjusting the output of the electric power source 450, or any combination of these adjustments.

The variable positioning of the magnetic poles or the electrical contact brushes may be achieved in numerous ways. In addition to the simple hand-operated levers described above, an electrical or electromechanical actuator means may be used for automatic control. Each of the manual and electrical controls may be designed to operate in response to positional or electrical signals.

To facilitate understanding the operation of the invention, one should bear in mind that the operator applies force to rotate an armature which is fixed to and rotates in unison with an open conductor loop comprising a generator winding. For example, conductor loop 190 rotates in unison with armature 170. When open conductor loop 190 rotates along its rotational path to a point where commutator segments 245 at the ends of loop 190 contact electrical contact brushes 240, then current is induced to flow through conductor loop 190. This induced current also flows through load 230, which is coupled to loop 190 when commutator segments 245 contact electrical contact brushes 240.

Each time conductor loop 190 is rotated to the point of coupling with contact brushes 240 such that conductor loop 190 is coupled to load 230, induced current flows in loop 190 and through load 230. A secondary magnetic field is formed around loop 190, because of the presence of this induced current. This secondary magnetic field exerts a torque in opposition to the rotation of loop 190 by armature 170. The opposition torque produced on armature 170 as a result of the induced current flowing through loop 190 provides a reactive force against which the operator of the variable reactive force device must do work to overcome.

Figure 5A:
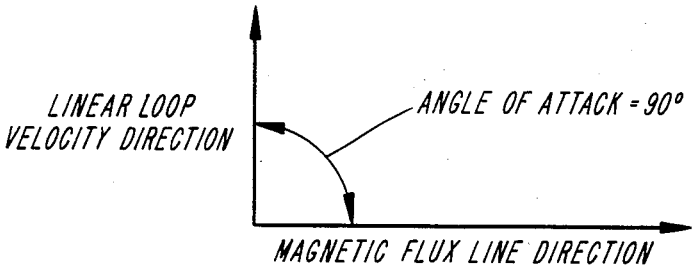
FIG. 5*a* is a diagram of the attack angle relationship between the loop velocity and the magnetic field direction of the embodiment of FIGS. 1 and 2, oriented as shown in FIG. 3.

By adjusting the position of brushes 240, the angle of attack of conductor loop 190 relative to the magnetic flux lines at the point where constant load 230 is coupled to loop 190, can be changed. The angle of attack (shown schematically in FIGS. 5*a* and 5*b*) is the angle between the vector characterizing the magnetic field direction and the linear velocity vector characterizing the movement of conductor loop 190. For example, as shown in FIGS. 3 and 5*a*, the plane of loop 190 is parallel to magnetic flux lines 250, which means that the angle of attack between conductor loop 190 and magnetic flux lines 250 is 90°.

For any given constant electrical load 230 and constant rotational speed of loop 190, the induced current in loop 190 is maximized when conductor loop 190 moves at right angles to flux lines 250 of the fixed magnetic poles 210 and 220. This is because movement of loop 190 at a 90° angle relative to the magnetic field direction permits loop 190 to cut across the most lines of magnetic flux, corresponding to the maximum possible intensity of the magnetic field, encountered by loop 190 as loop 190 moves through any given angular distance. As shown in FIG. 3 for example, magnetic flux lines 250 extend between fixed magnetic poles 210 and 220 in planes which are parallel to the plane of conductor loop 190 at the point in the rotational path of loop 190 illustrated. Thus, since brushes 240 are positioned to couple loop 190 to load 230 at the illustrated orientation of loop 190 relative to flux lines 250, and as loop 190 rotates according to the direction of arrows 270, loop 190 is moving at right angles to magnetic flux lines 250 at the moment of coupling with load 230, and the induced current in loop 190 is maximized. This relationship is further illustrated by the diagram of FIG. 5*a* which shows a representation of the relative angle of intersection between a linear loop velocity vector and the magnetic field vector for the position of loop 190 illustrated in FIG. 3.

Figure 5B:
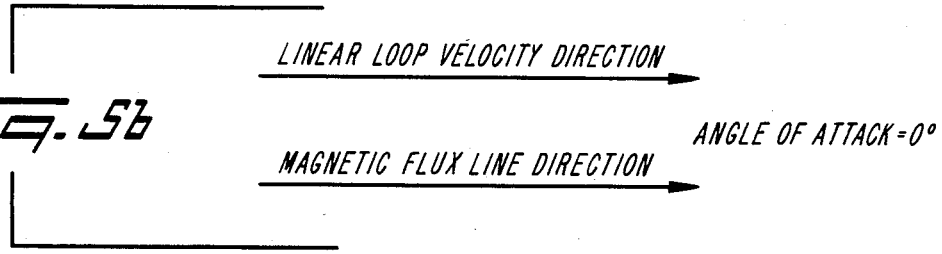
FIG. 5*b* is a diagram of the attack angle relationship between the loop velocity and the magnetic field direction of the embodiment of FIGS. 1 and 2, oriented as shown in FIG. 4.

If electrical contact brushes 240 are oriented such that load 230 is coupled to conductor loop 190 when the angle of attack between conductor loop 190 and magnetic flux line 250 is 0° , as shown in FIGS. 4 and 5*b*, then the current induced in loop 190 is at a minimum value. This is because loop 190 is moving essentially parallel to flux lines 250 at this predetermined point in the rotational path of loop 190, so no flux lines are being cut by loop 190. Thus, the opposition torque produced on loop 190 also is a minimum. In this case, any loading felt by the operator of the reactive force exercise device of the present invention would be at an absolute minimum and largely comprising windage and friction losses.

Figure 5C:
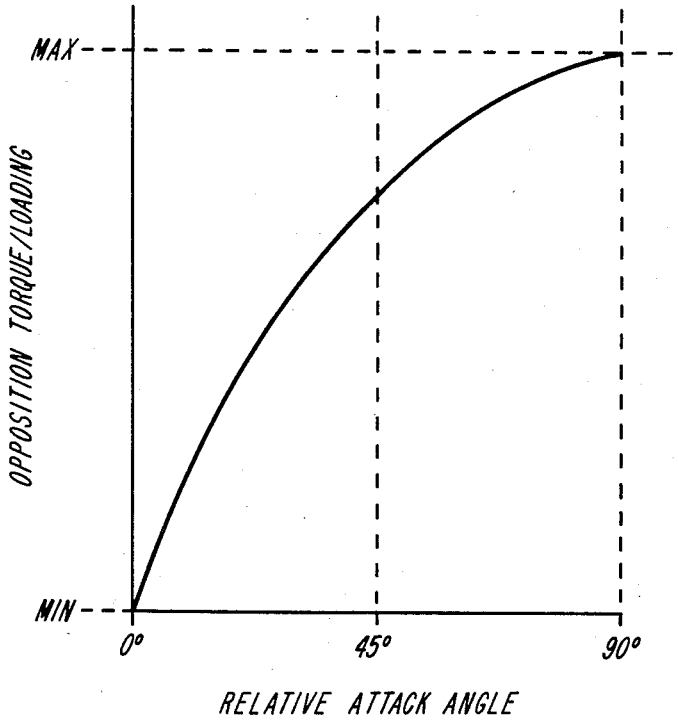
FIG. 5*c* is a graphical representation of one of the operating characteristics of the present invention.

As shown in FIG. 5*c*, intermediate angles of attack between loop 190 and magnetic flux line 250 result in intermediate magnitudes for the opposition torque produced on loop 190. It being understood that the opposition torque operates in opposition to the physical force produced by the operator on armature 170, the magnitude of the opposition torque which the operator must overcome to drive armature 170 via cranks 60 becomes a function of the angle of attack between loop 190 and flux lines 250 at the point when brushes 240 couple load 230 to loop 190. Any intermediate position of brushes 240 will allow an intermediate current to flow, the relative magnitude of which is dependent upon the relative angle and speed at which loop 190 is traversing the magnetic field between poles 210, 220 when electrical coupling is effected between brushes 240 and loop 190. These intermediate brush positions result in intermediate opposition torques and intermediate loading upon the rotating armature 170. By varying the position of brushes 240, different angles of attack may be chosen. Each angle of attack corresponds to a different constant opposition torque being applied to armature 170, for any fixed number of revolutions per minute (RPM) for armature 170. The plot of relative attack angle versus resulting torque/loading shown in FIG. 5*c*, to a first approximation, looks like a portion of a sine curve, which is sufficiently linear for most applications.

In the embodiments thus far described, the brush assembly or the magnetic poles of permanent magnetic motors may be modified for externally controllable, 90° rotational capability, which is preferred. This embodiment provides a smooth variation in induced armature loop current, and thus a smoothly varying torque/loading upon the exercise device operator, who is attempting to drive armature 170. The resultant structure has no external wiring or "exposed" current carrying members. As a further result of the metallic housing, the control means would not emanate or conduct, nor be susceptible to interferring radiation, which from an EMI/RFI standpoint is one concern of ever increasing importance in today's electronic climate. Additionally, wiring arrangements obviously may be utilized to obtain the full range of maximum to minimum opposition torque magnitudes with brushes or magnetic poles positioned for rotational displacement angles other than 90° .

Figure 11:
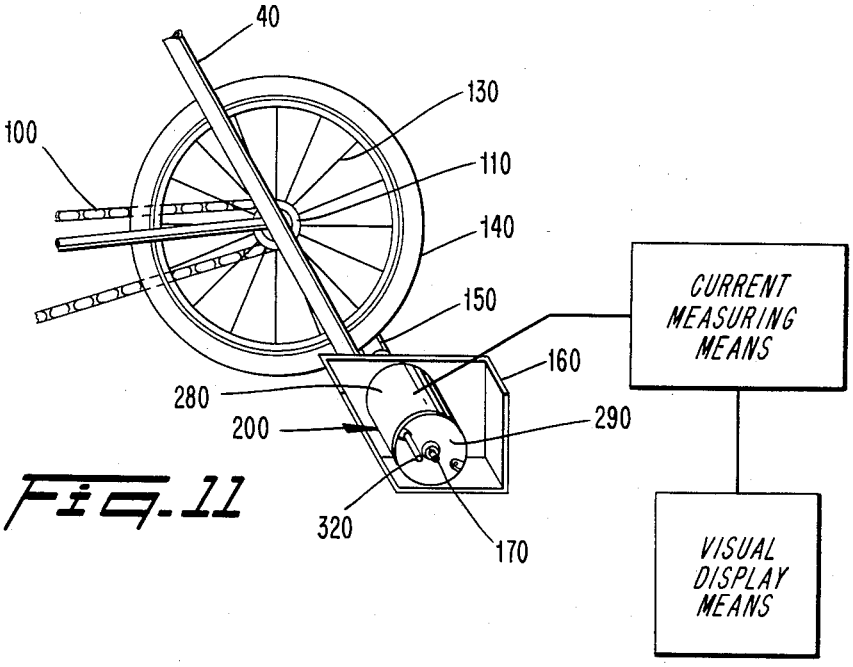
FIG. 11 is a partial schematic of current measuring means and visual display means shown in conjunction with the preferred embodiment of the present invention of FIGS. 1 and 2.

It is contemplated to use the subject invention in connection with various work measuring or monitoring instruments. In this way it becomes possible to provide the operator with information that will permit the operator to regulate and monitor the amount of energy expended using the exercise device. This is especially important when the use of the exercise device is part of a rehabilitation program conducted under the guidance of a health care professional. The induced current through the load coupled to the brushes may be calibrated and displayed on a visual monitor as RPM, torque, horsepower, etc., for these applications. Any of various means known in the art for measuring current, could be employed for measuring the induced current through load 230. Illustrative examples of display means for visually representing these current measurements would include ammeter gages, oscilloscope displays and digital LED displays. Other electro-optical systems or mechano-optical systems could be used in combination with the current in load 230 to create visual displays for the operator of the present invention. These contemplated uses of the present invention are illustrated schematically in FIG. 11.

Figure 12:
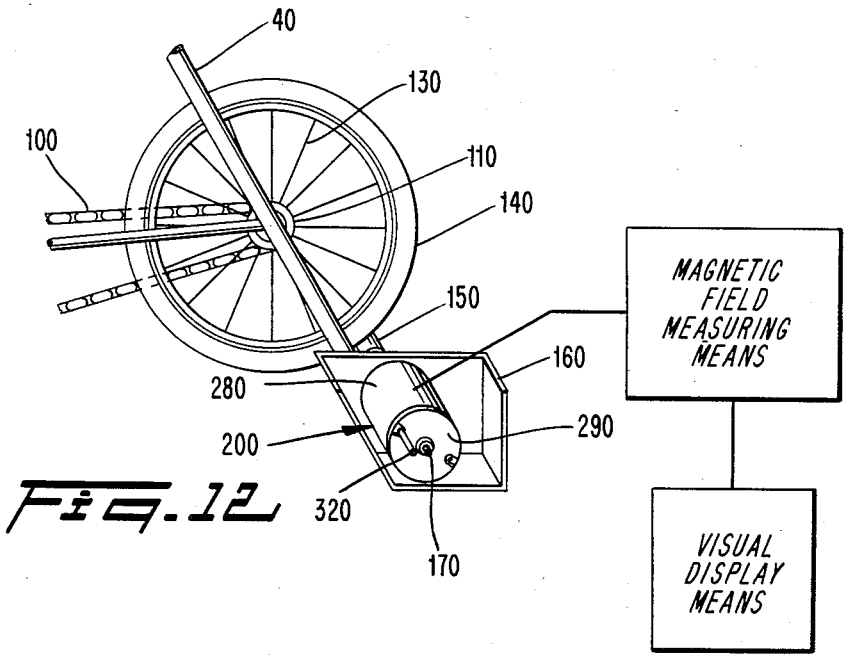
FIG. 12 is a partial schematic of magnetic field measuring means and visual display means shown in conjunction with the preferred embodiment of the present invention of FIGS. 1 and 2.
Figure 13:
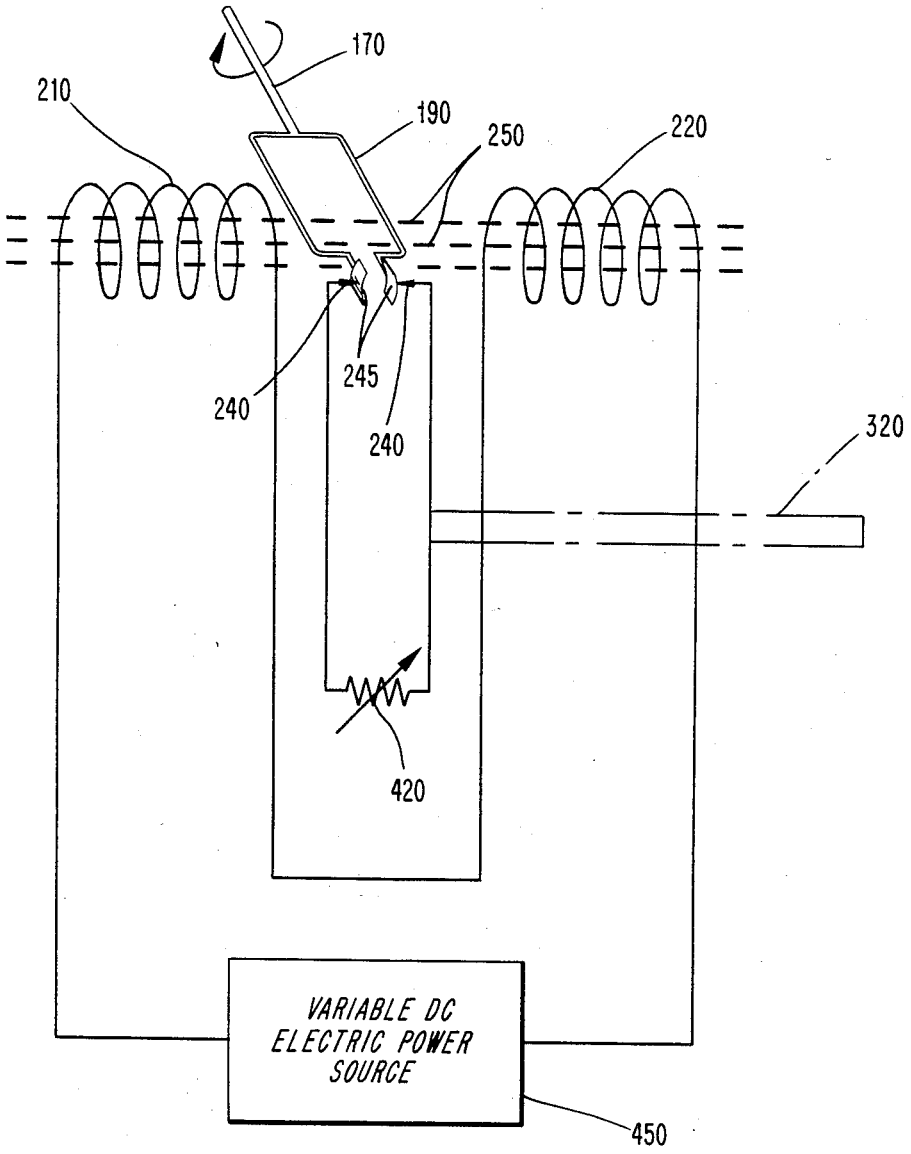
FIG. 13 is a partial schematic of a second example of an alternative embodiment of the magnetic field generating means and an alternative embodiment of the load of the present invention.

In a further example of the use of the present invention in connection with exertion monitoring instruments, the secondary magnetic field generated around load 230 may be measured using any of various magnetic detection devices known in the art of measuring magnetic fields. Hall effect devices, magnetic resistors, magneto-polarimeters, magneto-colorimeters and iron core oscillators are some illustrative examples. These magnetic field measurements likewise could be presented to the exercise device operator on a visual display. Any of various magneto-optical devices could be used in combination with the secondary magnetic field induced around load 230 for the purpose of creating visual displays to be observed by the operator of the present invention. Such arrangements for employing the present invention are illustrated schematically in FIG. 12.

Load 230 is preferably a short circuit 400, as shown in FIGS. 8 and 9, so that the combination of loop 190 and short circuit 400 presents little resistance, thereby generating a substantial induced current in loop 190 that in turn produces a large secondary magnetic field. This secondary magnetic field produces the opposition torque that opposes rotation of loop 190 and armature 170, and ultimately, must be overcome by the force applied by the operator to cranks 60.

Current only flows through conductor loop 190 when the loop is in the orientation at which contact is made with brushes 240 via commutator segments 245. Only when current flows through loop 190 is any opposition torque applied to armature 170. Thus, as each conductor loop 190 of generator 200 comes into contact with brushes 240 via commutator segments 245 and is thereby coupled to load 230 such that current flows through loop 190, an additional torque moment is applied to armature 170. Since a large plurality of loops 190 comprise generator 200, opposition torque may be considered to be applied continuously to armature 170 for practical purposes. The magnitude of this opposition torque is constant, so long as the relative attack angle between each loop 190 and the magnetic lines of flux remains the same at the point of coupling between each loop 190 and load 230, and the velocity of the loop, i.e , the number of RPM's, remains constant.

Additional advantages and modifications may readily occur to those skilled in the art. The invention in its broader aspects is not, accordingly, limited to the specific details, representative methods and illustrative examples shown and described. Accordingly, departures may be made from such details without departing from the spirit or scope of applicant's general inventive concept.

What is claimed is:

1. A variable, reactive force, exercise device comprising:

means for generating a magnetic field;

an armature having at least one open conductor loop and being rotatable along a rotational path cutting across magnetic flux lines of said field;

operator means for enabling an operator of said exercise device through the exertion of physical force to rotate said armature;

an electrical load;

at least two electrical contact brushes, said load being electrically coupled between said brushes and said brushes being positioned to couple said load electrically to said loop at least at one point in said loop's rotational path where said loop is at said a predetermined orientation relative to the magnetic flux lines of said magnetic field; and control means for selectively varying the relative orientation of said loop to said magnetic flux lines at least at one point in said loop's rotational path where said loop is coupled to said load whereby the physical force required to rotate said armature varies as a function of said control means.

2. A variable, reactive force, exercise device comprising:

a rotatably mounted armature having at least one open conductor loop;

means for at least partially enclosing said armature;

operator means for enabling an operator of said device through the exertion of physical force to rotate said armature with its said conductor loop;

means for generating a magnetic field, the position of said generating means being fixed relative to said enclosure means and wherein said rotating loop cuts across magnetic flux lines of said magnetic field;

at least two electrical contact brushes positioned in a fixed orientation relative to each other for being coupled with and thereby closing said loop where said loop is rotated to a predetermined position relative to the position of said magnetic flux lines;

an electrical load connected between said brushes; and control means for selectively positioning said brushes to vary, accordingly, said predetermined position of said loop relative to said magnetic flux lines where said loop is closed by being coupled with said brushes whereby the physical force required to rotate said armature varies as a function of said control means.

3. A variable, reactive force, exercise device comprising:

a rotatably mounted armature having at least one open conductor loop;

means for at least partially enclosing said armature;

operator means for enabling an operator of said device through the exertion of physical force to rotate said armature with its said conductor loop;

means for generating a magnetic field positioned relative to said loop wherein said rotating loop cuts across magnetic flux lines of said magnetic field;

at least two electrical contact brushes positioned in a fixed orientation relative to each other and relative to said enclosure means for being coupled with and thereby closing said loop where said loop is rotated to a predetermined position relative to the position of said magnetic flux lines;

an electrical load connected between said brushes; and control means for selectively positioning said magnetic field generating means relative to said enclosure means to vary, accordingly, said predetermined position of said loop relative to said magnetic flux lines where said loop is closed by being coupled with said brushes whereby the physical force required to rotate said armature varies as a function of said control means.

4. A variable, reactive force, exercise device of claim 1, wherein said electrical load comprises a short circuit.

5. A variable, reactive force, exercise device of claim 2, wherein said electrical load comprises a short circuit.

6. A variable, reactive force, exercise device of claim 3, wherein said electrical load comprises a short circuit.

7. A variable, reactive force, exercise device of claim 1, wherein the magnitude of the electrical resistance associated with said electrical load is selectively variable.

8. A variable, reactive force, exercise device of claim 7, wherein the magnitude of the magnetic field generated by said magnetic field generating means is selectively variable.

9. A variable, reactive force, exercise device of claim 1, wherein said control means is manually operable.

10. A variable, reactive force, exercise device of claim 2, wherein said control means is manually operable.

11. A variable, reactive force, exercise device of claim 3, wherein said control means is manually operable.

12. A variable, reactive force, exercise device of claim 1, further comprising:

measuring means for instantaneously measuring the induced current flowing through said load and for integrating said current over time; and display means for visually displaying said current data and said time integrated current data to the operator.

13. A variable, reactive force, exercise device of claim 2, further comprising:

measuring means for instantaneously measuring the induced current flowing through said load and for integrating said current over time; and display means for visually displaying said current data and said time integrated current data to the operator.

14. A variable, reactive force, exercise device of claim 3, further comprising:

measuring means for instantaneously measuring the induced current flowing through said load and for integrating said current over time; and display means for visually displaying said current data and said time integrated current data to the operator.

15. A variable, reactive force, exercise device of claim 1, further comprising:

measuring means for instantaneously measuring a secondary magnetic field generated around said load upon operation of said device; and display means for visually displaying said measured secondary magnetic field data to the operator.

16. A variable, reactive force, exercise device of claim 2, further comprising:

measuring means for instantaneously measuring a secondary magnetic field generated around said load upon operation of said device; and display means for visually displaying said measured secondary magnetic field data to the operator.

17. A variable, reactive force, exercise device of claim 3, further comprising:

measuring means for instantaneously measuring a secondary magnetic field generated around said load upon operation of said device; and display means for visually displaying said measured secondary magnetic data to the operator.

18. A variable, reactive force, exercise device of claim 2, wherein said enclosure means includes a cylindrical metal housing, and wherein said control means includes:

a circular metal end plate having a cylindrical edge for frictionally engaging an inside surface of one end of said housing and being rotatable thereon, a circular insulative support disc having means for slidably securing said brushes on one side of said disc and said disc being fixed on the other side to an interior surface of said end plate, and a handle fixed to an outer edge of said end plate on a surface opposite to said interior surface on which said disc is fixed.

19. A variable, reactive force, exercise device of claim 2, wherein said enclosure means includes a cylindrical metal housing, said housing having a circumferential groove extending along approximately one quarter of a circumference thereof and wherein said control means includes:

a circular insulative support disc having means for slidably securing said brushes on one side of said disc, a cylindrical sleeve having one edge fixed to said support disc, and a handle extending outboard said housing and engaging said sleeve through said groove in said housing for rotation of said sleeve by movement of said handle.

20. A variable, reactive force, exercise device comprising:

an armature having a conductor which forms an open loop;

means for generating a magnetic field;

means for enabling an operator of said exercise device, through the exertion of physical force, to rotate said armature within said magnetic field to move said loop through a rotational path centered about said armature and thereby induce a current within said conductor;

an electrical load;

means for coupling said electrical load to said conductor to close said loop at a selective orientation of said loop in said rotational path relative to said magnetic field; and means for varying the force required by said operator to rotate said armature, comprising means for varying said selective orientation of said loop relative to said magnetic field.

* * * * *